US006511373B2

(12) United States Patent
Howard et al.

(10) Patent No.: US 6,511,373 B2
(45) Date of Patent: Jan. 28, 2003

(54) CORNICE DUCT SYSTEM

(75) Inventors: Thomas C. Howard, Raleigh, NC (US); Manoel L. Gonzalez, Raleigh, NC (US); J. Wayne Place, Raleigh, NC (US)

(73) Assignee: Synergetics, Inc., Raleigh, NC (US)

( * ) Notice: Subject to any disclaimer, the term of this patent is extended or adjusted under 35 U.S.C. 154(b) by 0 days.

(21) Appl. No.: 09/761,145

(22) Filed: Jan. 16, 2001

(65) Prior Publication Data

US 2002/0094773 A1 Jul. 18, 2002

(51) Int. Cl.[7] ..... F24F 13/072

(52) U.S. Cl. ..... 454/298; 454/288; 454/296; 454/306

(58) Field of Search ..... 454/76, 108, 137, 454/287, 288, 293, 295, 297, 298, 301, 303, 304, 306, 324, 334, 245, 246, 247, 248

(56) References Cited

U.S. PATENT DOCUMENTS

| | | | | |
|---|---|---|---|---|
| 1,941,425 | A | | 12/1933 | Young |
| 2,239,508 | A | * | 4/1941 | Sipp et al. |
| 2,355,629 | A | | 8/1944 | Carrier |
| 2,359,505 | A | | 10/1944 | Barnes |
| 2,395,233 | A | * | 2/1946 | Richardson |
| 2,796,015 | A | * | 6/1957 | Hayes |
| 2,970,678 | A | * | 2/1961 | Brinen |
| 3,515,052 | A | * | 6/1970 | Brandes |
| 3,616,587 | A | | 11/1971 | Schlafly, Jr. |
| 3,827,202 | A | | 8/1974 | Phillips |
| 4,534,147 | A | | 8/1985 | Cristell |
| 4,672,887 | A | * | 6/1987 | Sproul, Sr. |
| 4,696,136 | A | | 9/1987 | Grewe |
| 5,263,290 | A | * | 11/1993 | Gardner |
| 5,660,584 | A | | 8/1997 | Serrano |
| 5,809,718 | A | | 9/1998 | Wicks |

FOREIGN PATENT DOCUMENTS

| | | | | |
|---|---|---|---|---|
| CA | 507683 | * | 11/1954 | ..... 454/306 |
| CH | 112969 | * | 1/1945 | ..... 454/306 |
| FR | 2 619 199 | * | 2/1989 | ..... 454/306 |
| GB | 377634 | * | 2/1932 | ..... 454/306 |
| NL | 297676 | * | 11/1965 | ..... 454/306 |

* cited by examiner

*Primary Examiner*—Harold Joyce
(74) *Attorney, Agent, or Firm*—Coats & Bennett, P.L.L.C.

(57) ABSTRACT

An energy efficient air distribution system placed within the conditioned space of a building comprising a duct having an interior volume for conducting air. One of the exterior surfaces may have an ornamental design providing the impression the device is actually cornice molding. At least one recess is positioned along the exterior surface of the duct, such that it is obscured from view by a viewer standing within an occupancy zone of a room. An outlet is positioned within the recess for directing a flow of air from the duct interior volume through the exterior surface. The duct serves a function of conducting air throughout the room, and also has an aesthetically pleasing appearance. Junction boxes may be placed within the conditioned space for connecting the ducts. Junction boxes may further include an ornamental exterior for a pleasing aesthetic appearance. Air flow controlling and conditioning mechanisms may be positioned within one or more of the junction boxes for affecting the flow of conditioned air through the network.

26 Claims, 10 Drawing Sheets

CORNICE DUCT SYSTEM

FIELD OF THE INVENTION

The present invention is directed to a HVAC duct system and, more particularly, to a duct system located in the conditioned space of a building for distributing heated or cooled air and having an aesthetically pleasing appearance.

BACKGROUND OF THE INVENTION

Traditional air distribution systems include duct work that extends between an air handling unit and a conditioned room space. Conditioned room space is the space occupied by persons within a building in which air may be heated, cooled, or otherwise conditioned. The duct work extends along the exterior, non-conditioned space between interior walls, above the ceiling, or below the floor such that it is not visible to a viewer. Approximately 25–40% of the energy (heating or cooling capacity) in ordinary air distribution systems is lost to duct leakage and heat conduction through duct walls. As energy becomes a more treasured commodity and as energy costs climb higher, methods for reducing these losses are becoming more important.

In a few modern architectural projects, the duct work has been exposed within the interior conditioned space by using utilitarian ducts suspended from the ceiling. Although energy efficient and acceptable in large open offices, this technique is not applicable to most intimate spaces such as smaller offices and residences, especially those having a more traditional designed environment. Additionally, exposed duct work may not be effective in distributing air. Often, the ducts distribute air through a limited number of outlet vents causing localized drafts that are very disruptive to the comfort zone of a space. In other situations, the conditioned air tends to stratify and not reach the occupancy zone of the space.

SUMMARY OF THE INVENTION

The present invention is directed to an air distribution system that functionally distributes conditioned air throughout a room, and also has an aesthetically pleasing appearance. The distribution system is positioned within the conditioned space such that any air leakage or heat conduction occurs within the conditioned space and is not wasted or lost, thus providing a more energy efficient air distribution system.

The duct is used for distributing the conditioned air. The duct defines a volume for conducting air, and has an exterior surface that may be ornamentally detailed and visible to a viewer. The duct exterior is shaped to form a recess behind the ornamental surface. At least one recess is positioned along the exterior surface and positioned such that it may be obscured from view. An outlet is positioned within the recess for directing a flow of air from the interior volume of the duct. The outlet is obscured by virtue of being located in the recess.

The duct may further include a joining edge positioned adjacent to the exterior surface for seating against a wall of the room. A flow control mechanism may be positioned over the outlet for selectively adjusting the flow of air from the interior volume of the duct through the exterior surface of the duct. A projection may extend outward from the exterior surface adjacent to each recess for further obscuring the recess from view.

The duct may be used in an air distribution system for delivering air throughout a conditioned space. The system includes a plurality of junction boxes arranged within the conditioned space. An air handler is operatively connected to at least one of the junction boxes for supplying air into the conditioned space. A plurality of ducts extend between the junction boxes. Each of the ducts has an ornamental surface adapted to be visible within the room, and at least one outlet for distributing air into the room. An air flow controller may be positioned within at least one of the junction boxes for controlling air flow into the ducts.

The system may be designed to direct air along the wall of interior spaces and/or the ceiling of the spaces. The junction boxes may be positioned within the corners of the interior spaces or rooms, and may also be positioned along substantially linear sections of the ducts. The junction boxes may contain an air flow controller, such as a baffle, diffuser, heat exchanger, damper, booster fan, filter, and other like air controlling device.

The present invention may also include a method of improving the aesthetic appearance of a room. The method includes positioning ornamentally rendered junction boxes having air flow controllers positioned therein on a wall of the conditioned space. Air may be directed through the junction boxes and into ducts providing an aesthetically pleasing appearance such that an observer remains essentially unaware that the junction boxes and ducts are an air distribution system.

The system also may provide a structure for placing lighting fixtures and cable trays. Various lighting fixtures may be positioned about the ducts and junction boxes to illuminate the walls and/or ceilings of the interior spaces. Additionally, the ducts and junction boxes may form cable trays for running phone, data, fiber-optic, and other like wires.

DETAILED DESCRIPTION OF THE INVENTION

Figure 1:
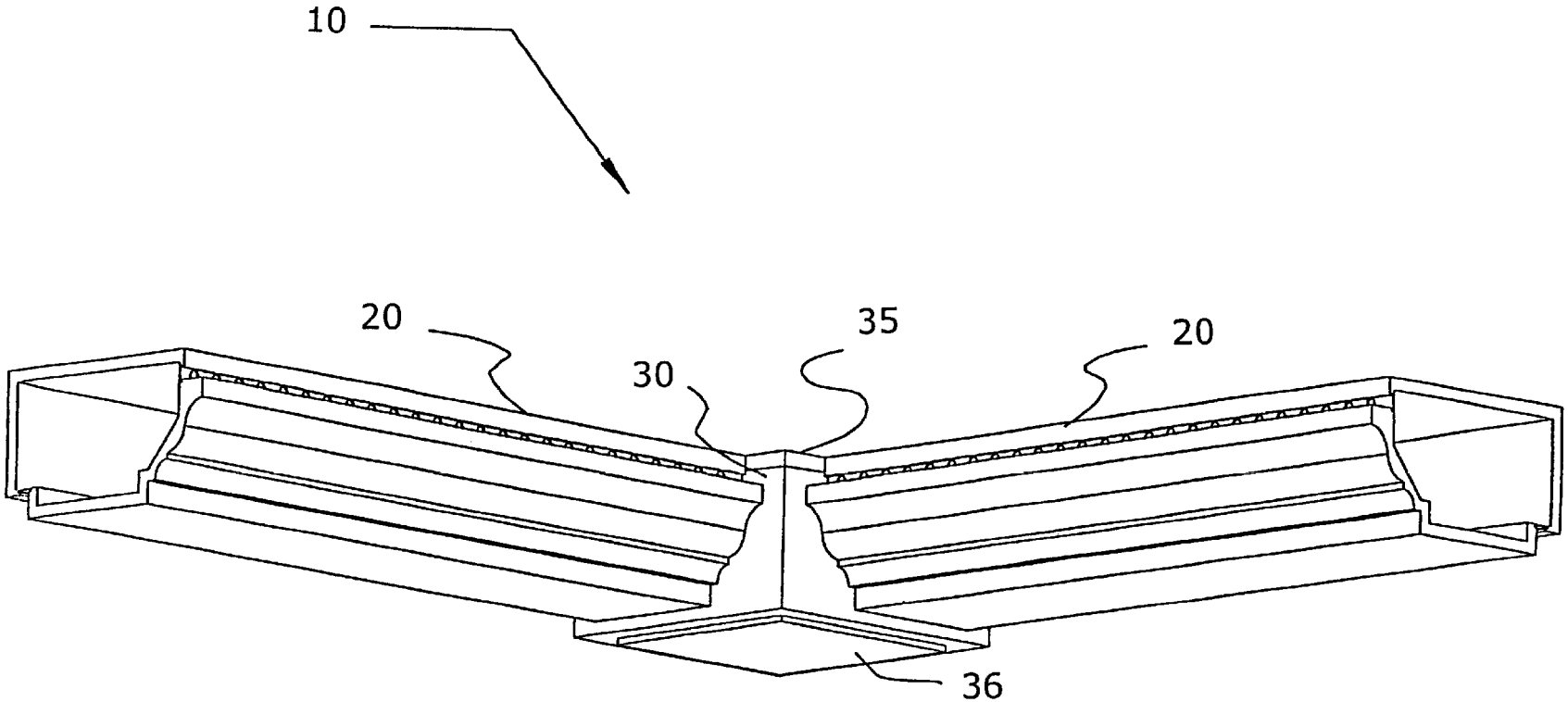
FIG. 1 is a partial perspective view illustrating an air distribution network constructed according to one embodiment of the present invention.
Figure 4:
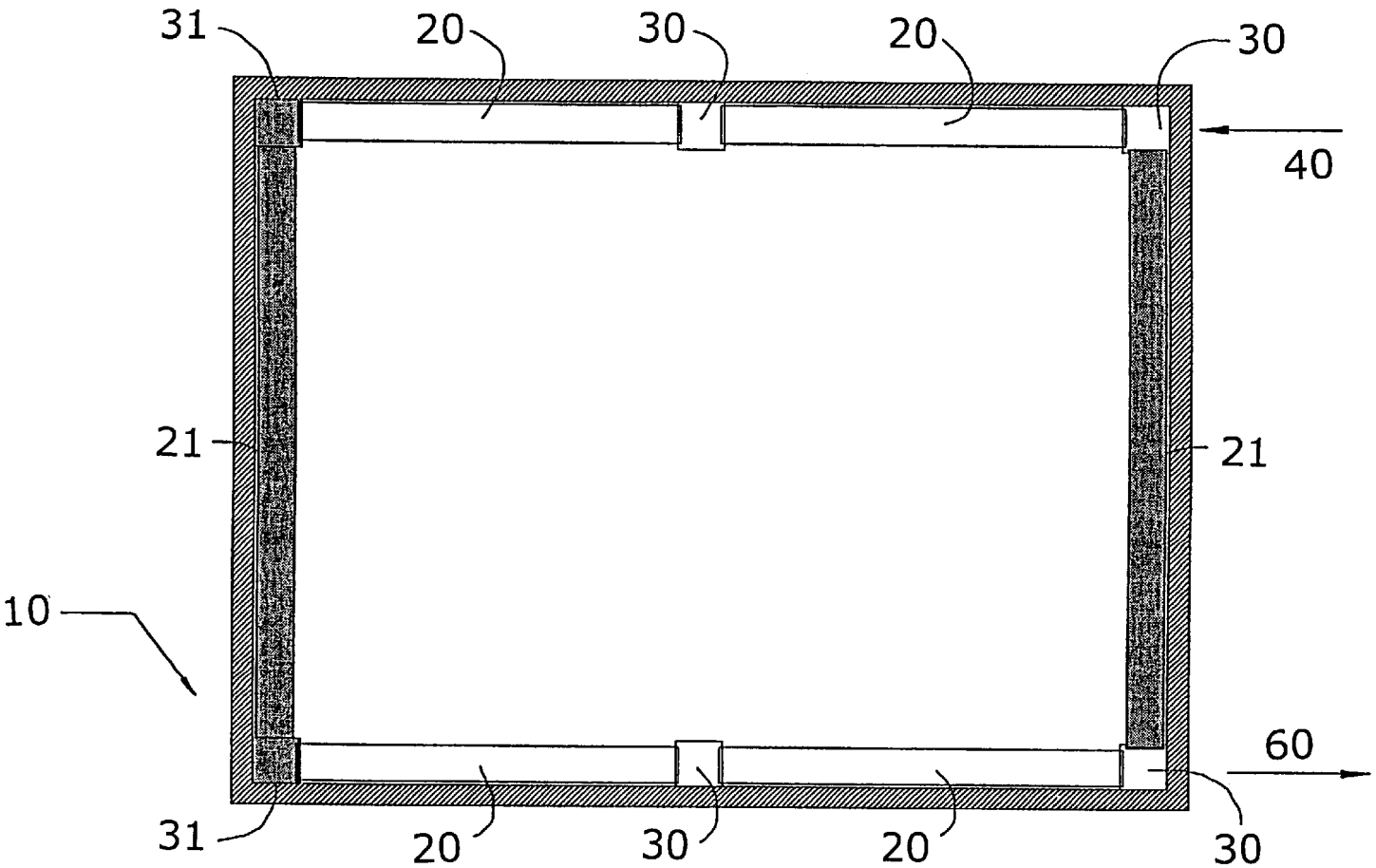
FIG. 4 is a schematic view of an air distribution network placed along the interior walls of a conditioned space.

The present invention is directed to an air distribution network, generally designated 10 in FIGS. 1, and 4, located in the conditioned space with the purpose of distributing conditioned air. Conditioned air is air that has been heated, cooled, humidified, filtered, or otherwise treated. A series of ducts 20 extend along the walls of the conditioned space for conducting and directing the air. The ducts 20 include outlets 28 (FIG. 2), which evenly distribute the air throughout the conditioned space. Junction boxes 30 (FIG. 1) are located about the space and connect the ducts 20 forming the distribution network 10. Junction boxes 30 may further include air-controlling devices for further distributing the air. Conditioned air is introduced into the air distribution network through at least one of the junction boxes 30. The conditioned air is conducted through the ducts 20 and passes through the outlets 28 into the conditioned space.

FIG. 1 illustrates a section of the distribution network 10. Junction box 30 is positioned within a corner of the room and connects two separate ducts 20. In one embodiment, the exterior surface of the ducts 20 and/or junction box 30 are ornamentally decorated thereby enhancing the appearance of the room. The distribution network 10 serves both the functional purpose of distributing air throughout the room while also providing an aesthetically pleasing appearance.

Figure 2:
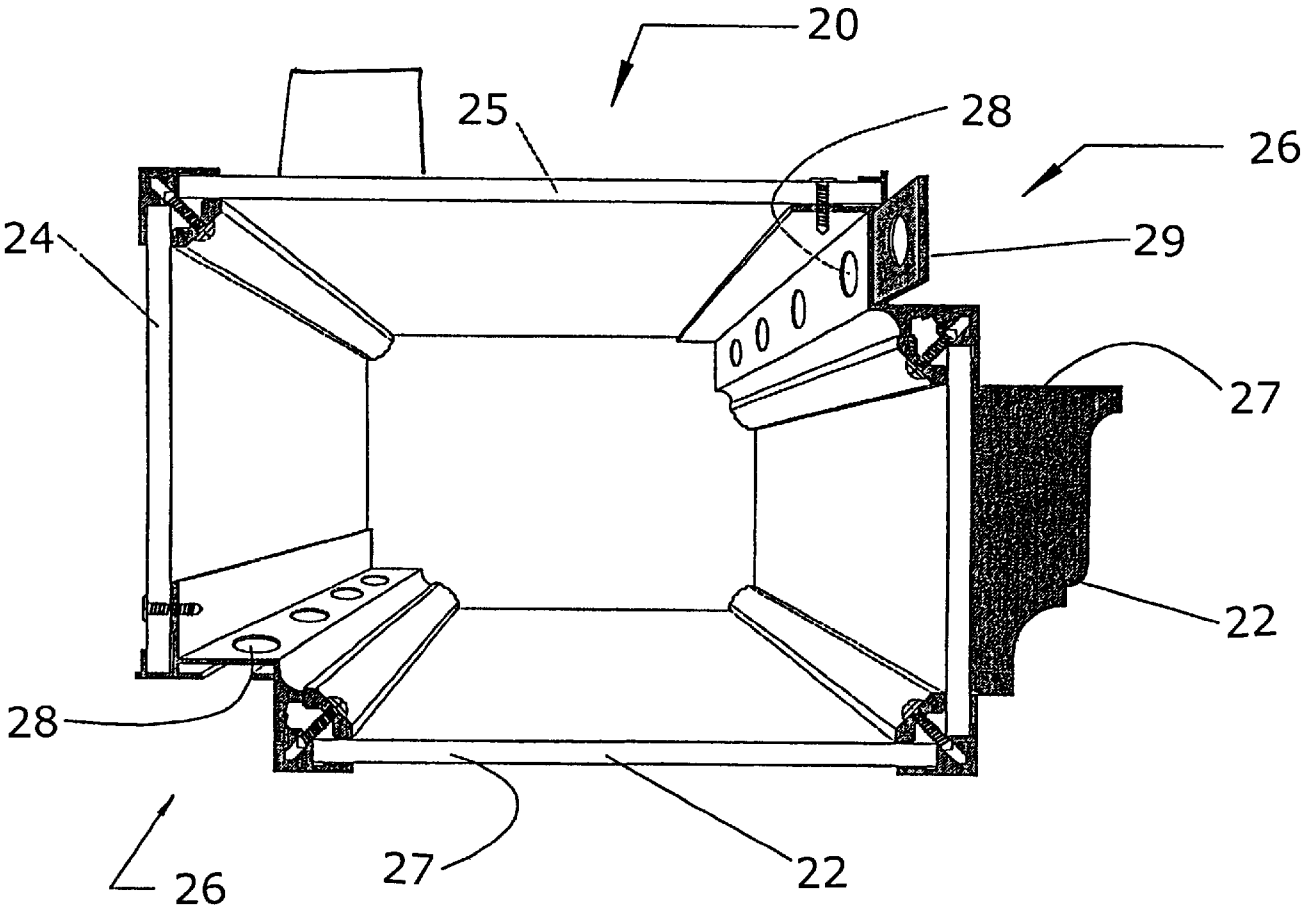
FIG. 2 is a cross-sectional view of a duct constructed according to one embodiment of the present invention.

FIG. 2 illustrates a cross-sectional view of the duct 20. Ornamental surface 22 extends around a portion of the duct 20 that is visible to a viewer positioned in the conditioned space where the distribution network 10 is mounted. Ornamental surface 22 may have a variety of designs giving the impression that the duct 20 is a decorative molding. As illustrated in FIG. 2, ornamental surface 22 comprises the surfaces that extend along the bottom and front side of the duct 20, e.g. front and bottom surfaces. Various ornamentation and designs are contemplated and are to be included within the scope of the present invention. In the disclosed embodiments, the front surface has a form reminiscent of a segment of crown molding. The bottom surface is illustrated and described as plain but does not detract from the appearance of the duct 20. Bottom surface may, however, contain additional ornamentation. Mounting surface 24, e.g. the back wall of the duct, abuts against or near the interior wall of the conditioned space. An upper wall having an upper surface 25 may also be substantially flat for mounting against the ceiling, or supporting an array of items such as luminaries that indirectly light the conditioned space when the top surface 25 is positioned away from the ceiling. Additionally, top surface 25 may include a cable tray for holding items including telephone lines, is electrical cables, data cables, fiber-optic cables, and the like such that they are not visible to a person within the conditioned space. Additionally, mirrored surfaces may be placed along the walls and ceiling to direct the light as necessary. Although the shape illustrated in FIG. 2 is substantially rectangular, other shapes and embodiments are also contemplated by the present invention.

At least one recess 26 may be formed in the duct 20 for hiding an outlet 28 and flow control mechanism 29. Outlet 28 is an opening in the duct wall through which air is diffused into the conditioned space. Flow control mechanism 29 extends over the outlet 28 and controls the flow rate of air being distributed. Ornamental surface 22 may form a projection 27 adjacent to the recess 26 such that the recess 26 is not easily visible by a viewer. As viewed in FIG. 1, the recesses are not easily visible by a person positioned within the occupancy zone of the room. By not being easily visible, recesses 26 and outlet 28 do not detract from the aesthetic appearance of the distribution network 10.

In one embodiment as illustrated in FIG. 2, a pair of recesses 26 and outlets 28 are formed in the duct 20, one at the intersection of the top wall and front wall of the duct 20 and one at the intersection of the back wall and bottom wall of the duct 20. Recesses 26 and outlets 28 are positioned such that air is directed along the ceilings and/or walls of the conditioned space. This positioning causes the air to migrate along the ceiling and/or wall surface to create a blanket of supply air that tends to offset the energy loads incurred by walls and windows, especially during the heating season, and energy loads from the ceiling during the cooling season. This position is also advantageous in that it creates a projected air pattern that is outside the occupancy zone of the space.

The flow control mechanism 29 may be positioned over the outlet 28 to control the direction and volume of air directed from the duct 20 into the conditioned space. One example of a flow control mechanism is a diffuser strip positioned over the outlets 28. The diffuser strip includes a plurality of orifices that overlay the outlets 28 and are adjustable to control the size of an opening through which air is directed. The flow control mechanism 29 may be manually adjustable such that a user may adjust the openings, or may be controlled by a remotely controllable device having a stepper motor which is especially convenient when the distribution network 10 is positioned within the upper reaches of the room and not easily accessible.

Ducts 20 have either a one-piece construction or a multi-piece construction. Either type construction provides for straight-forward installation as the duct ends are slipped into corresponding openings within the junction boxes 30 to complete the network 10. Ducts 20 and junction boxes 30 may be constructed from a variety of materials. Junction boxes 30 are selectively positioned throughout the distribution network 10. Openings 32 in the junction boxes 30 are sized and shaped to correspond to the cross section of the ducts 20 and are positioned on at least one side of the junction boxes 30 for receiving and supporting ducts 20. In one embodiment, openings 32 are sized such that duct 20 fits snugly within the opening 32 thereby limiting air leakage that occurs at the connection. Caulk or insulation may also be inserted within any gaps between the duct 20 and junction box 30 to further reduce air leakage. Exterior surface 36 may comprise a complementary ornamental design to complement the duct ornamental surface 22 for an aesthetically pleasing appearance for a viewer. As illustrated in FIG. 1, exterior ornamental surfaces 36 may include a bottom surface, and side walls through which ducts 20 extend.

Figure 3A:
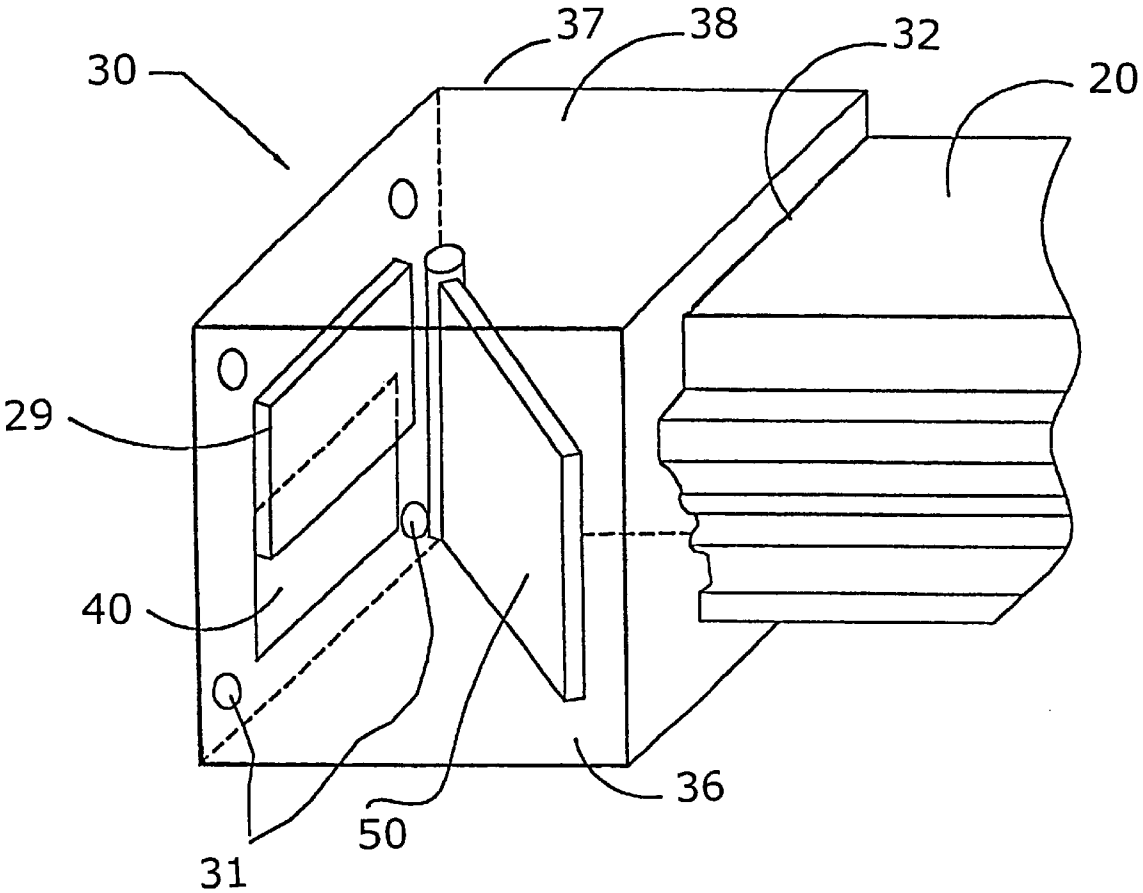
FIG. 3A is a cut-away perspective view of a junction box having a baffle and an attached duct.

As illustrated in FIG. 3A, mounting surfaces 37 are substantially flat such that they may be positioned against the wall of the conditioned space. Top surface 38 may likewise be flat and be positioned against the ceiling, or may be equipped with lights or other decorative motif depending on the desires of the user.

Figure 3B:
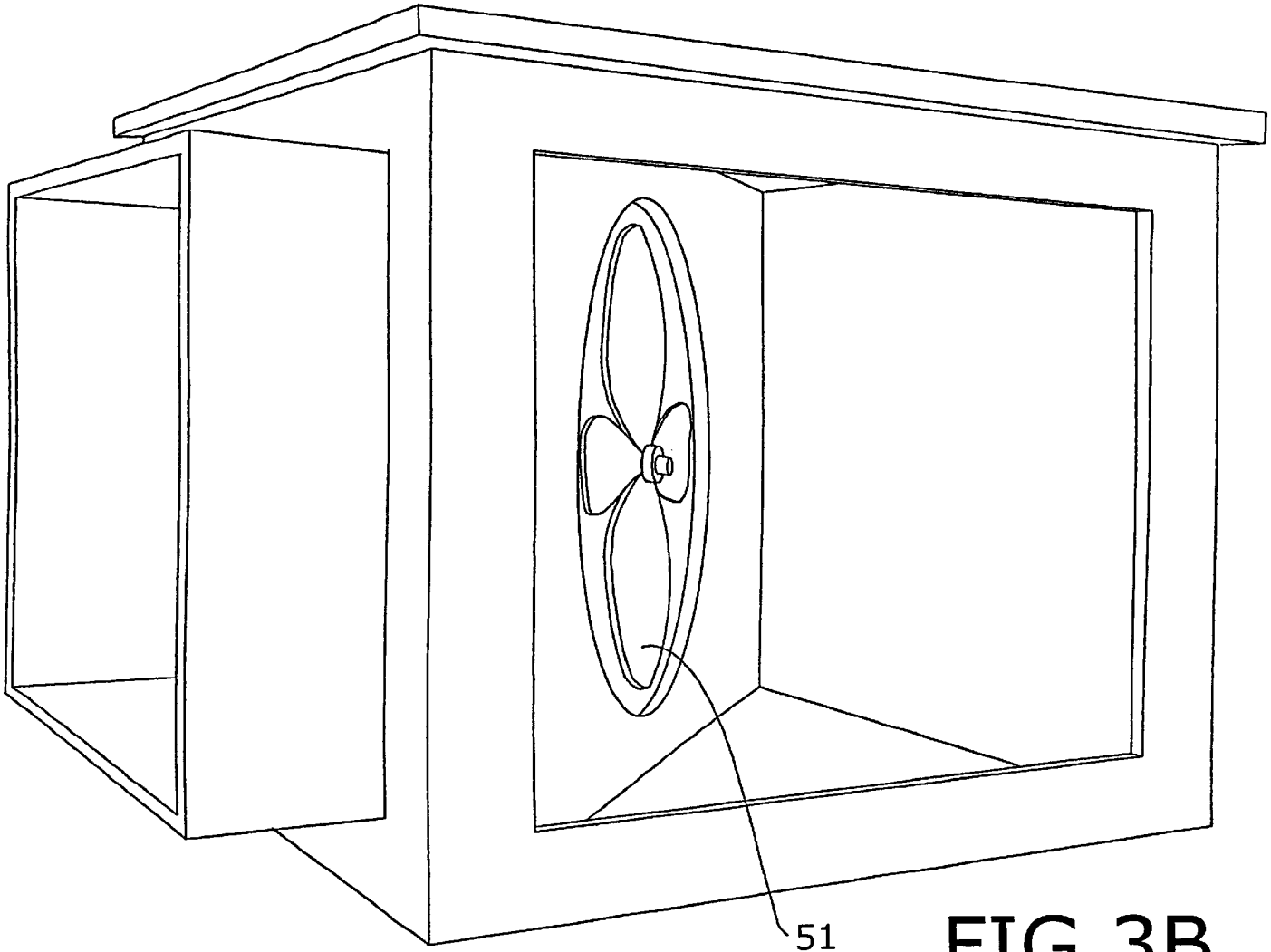
FIG. 3B is a partial schematic view of a junction box having a fan;.
Figure 3C:
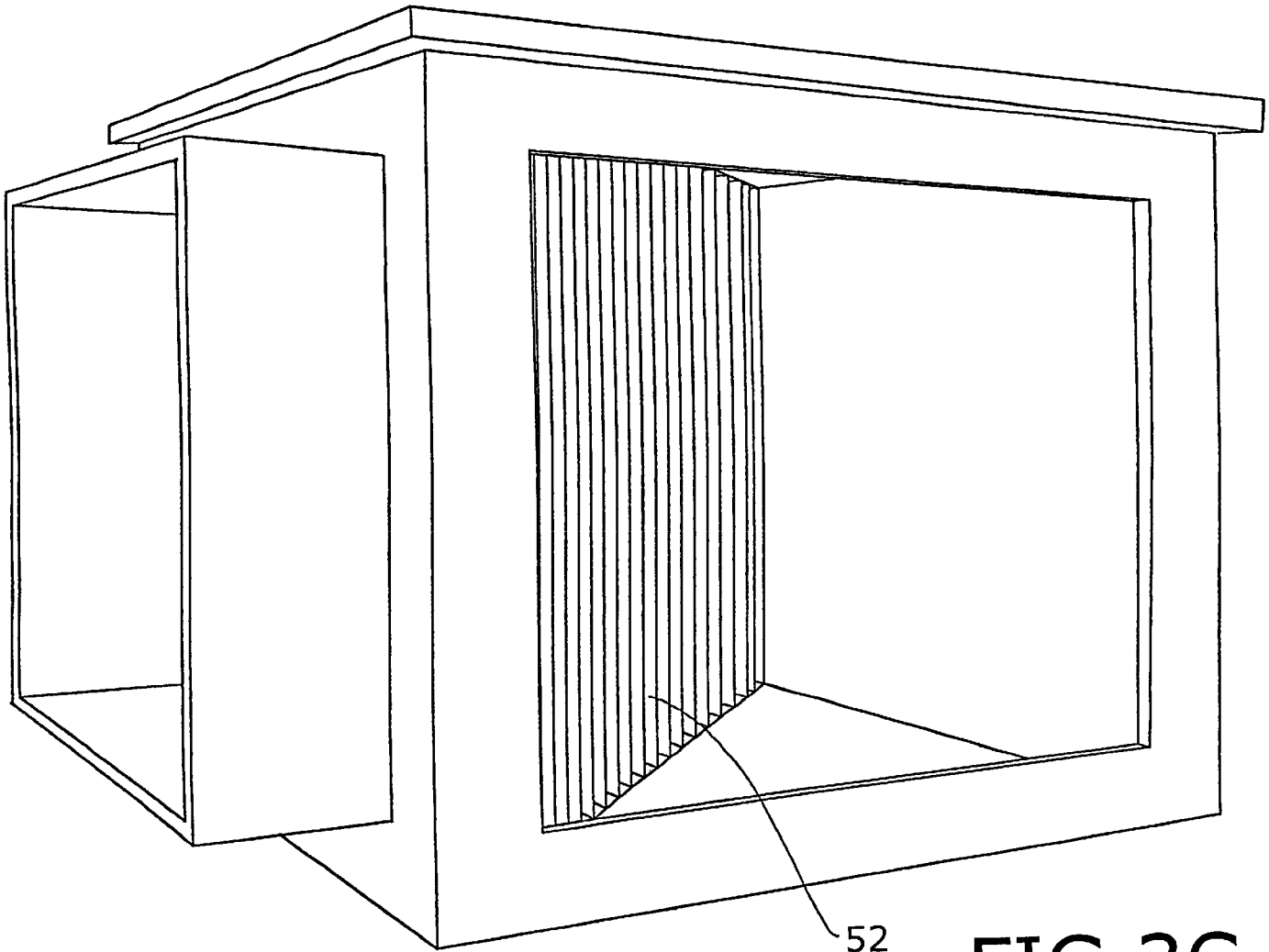
FIG. 3C is a partial schematic view of a junction box having a heat exchanger.
Figure 3D:
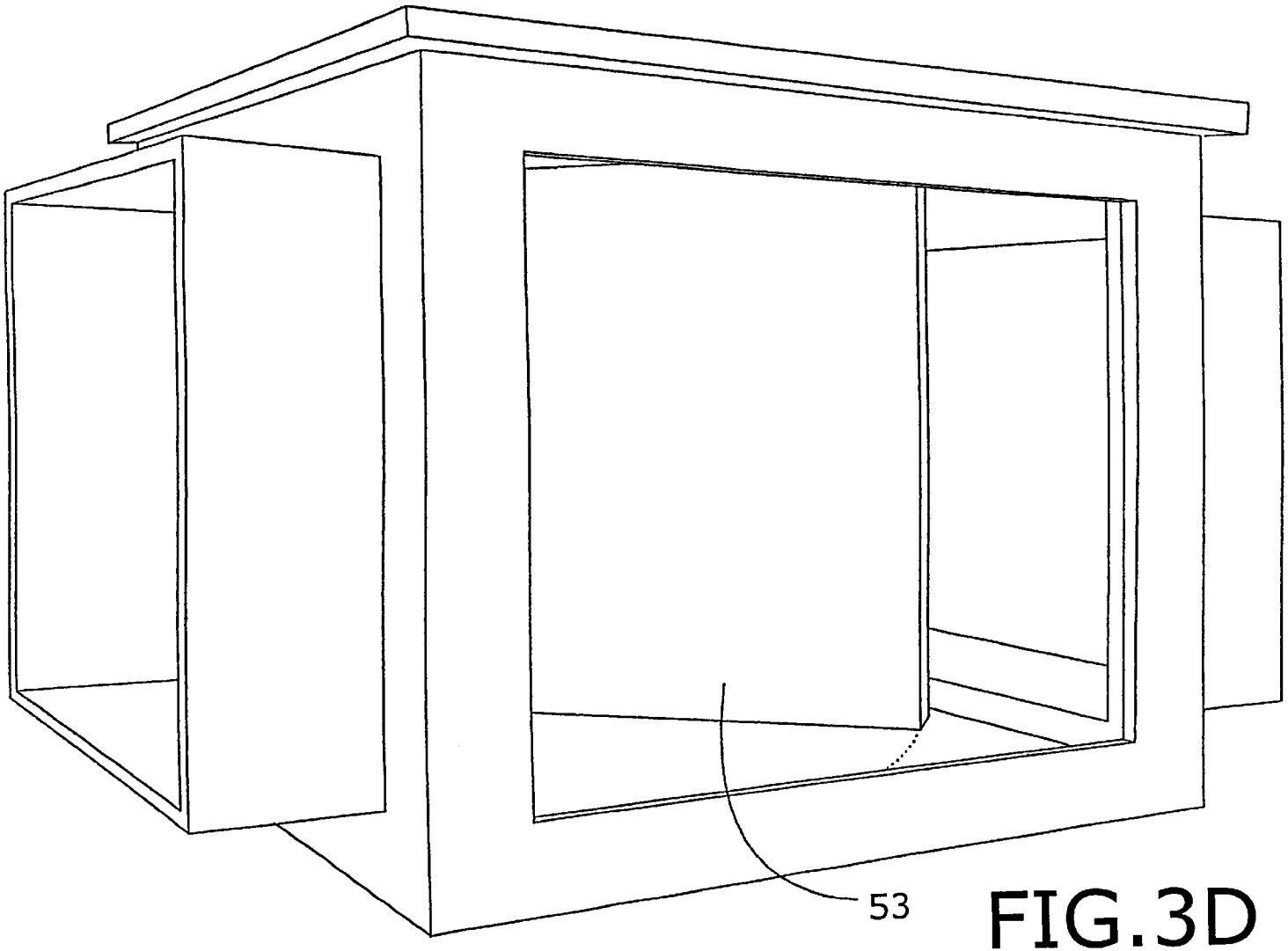
FIG. 3D is a partial schematic view of a junction box having a damper.
Figure 3E:
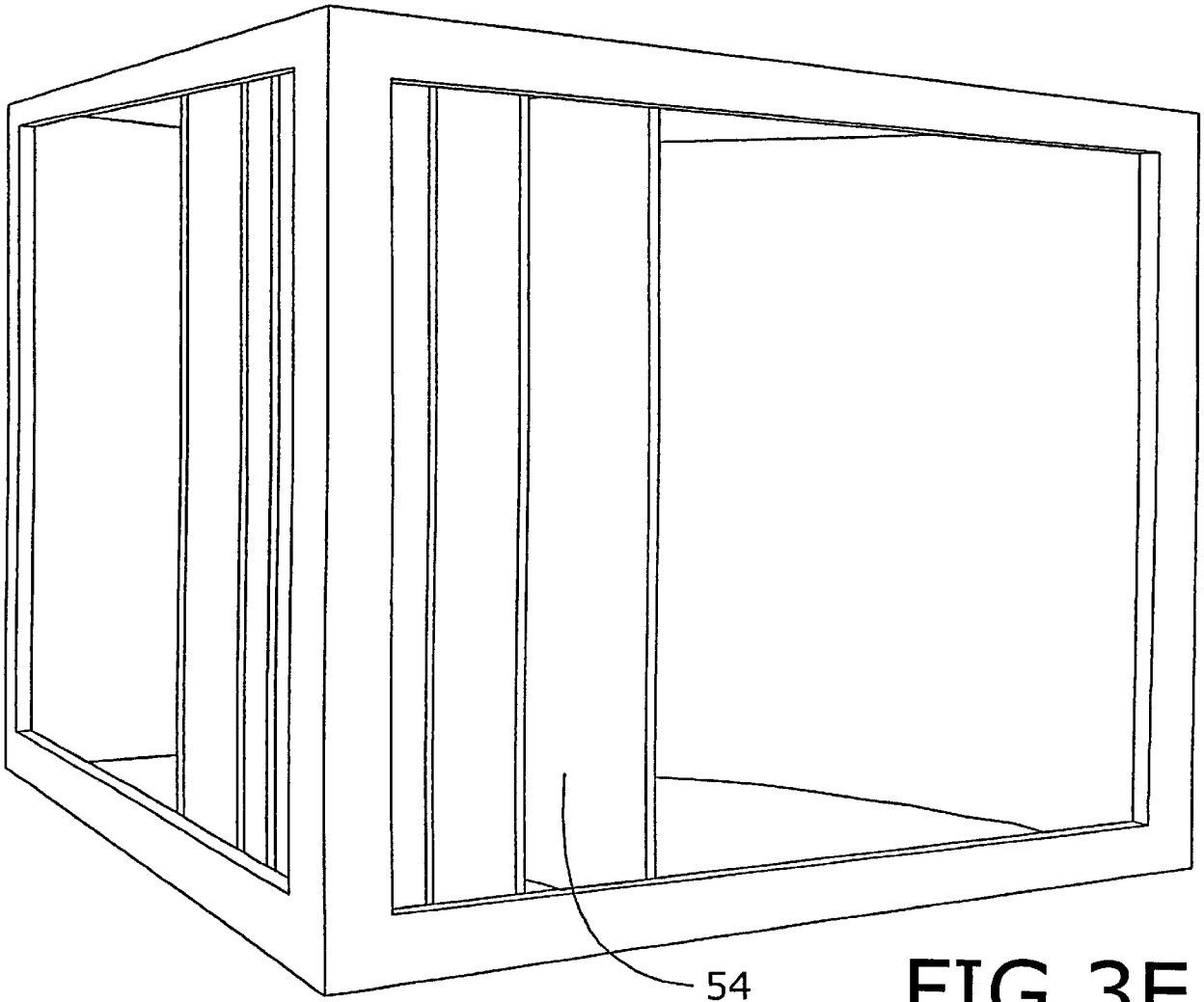
FIG. 3E is a partial schematic view of a junction box having turning vanes.
Figure 3F:
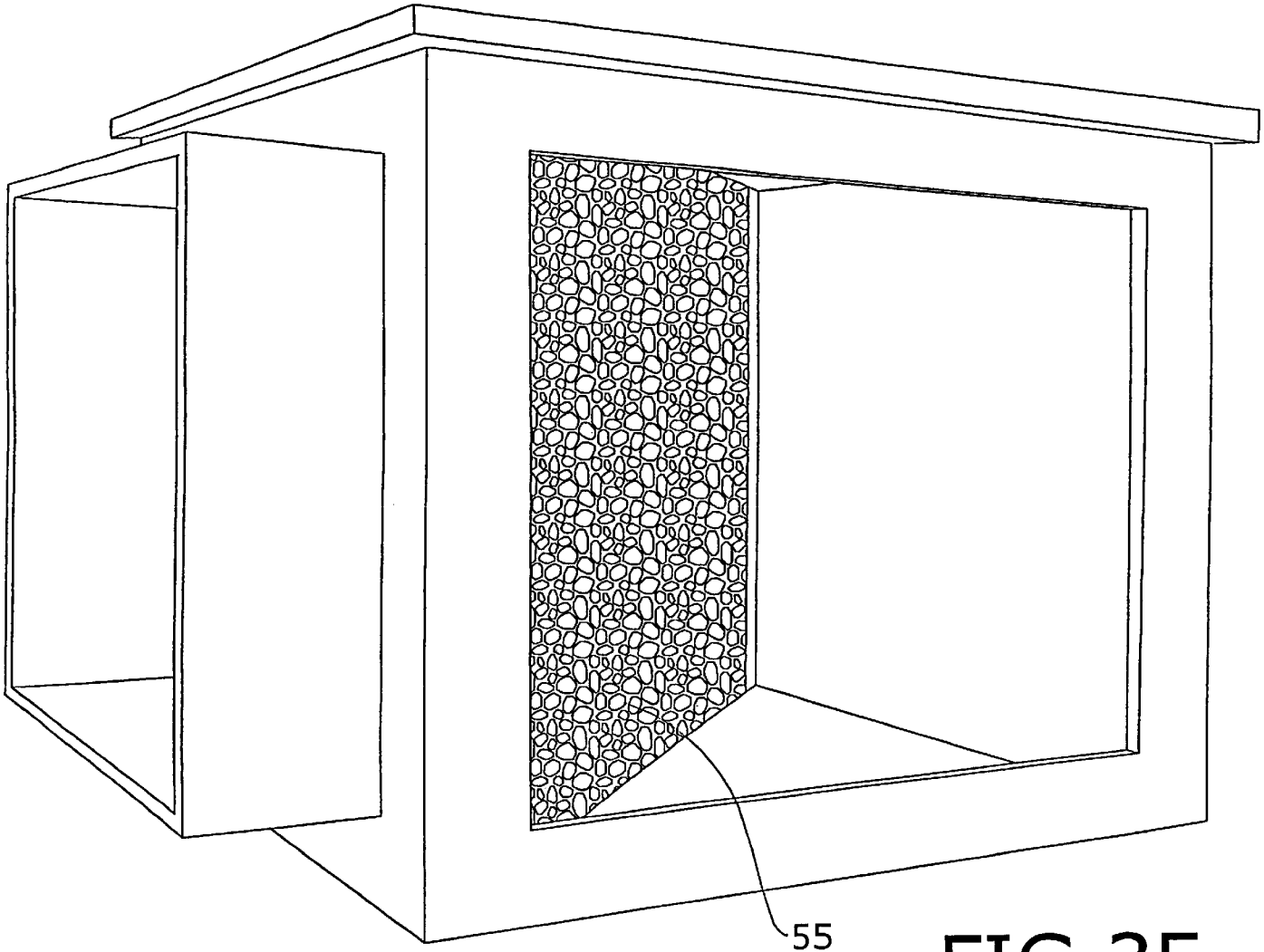
FIG. 3F is a partial schematic view of a junction box having a filter.

Air flow controllers may be positioned within one or more of the junction boxes 30 for directing or controlling the air flow through the distribution network 10. A variety of air flow controllers may be positioned within the network including: a baffle 50 for directing air into the ducts 20 as illustrated in FIG. 3A; a booster fan 51 for assisting the air handler and moving the air throughout the distribution network 10 as illustrated in FIG. 3B; a heat exchanger 52 as illustrated in FIG. 3C; a damper 53 for opening and closing ducts 20 within the network illustrated in FIG. 3D; a flow director 54 such as radiused corner bends and/or turning vanes to enhance air directional changes illustrated in FIG. 3E; and a filter 55 illustrated in FIG. 3F. Other air flow controllers may further be included and are within the scope of the present invention.

Junction boxes 30 may be positioned within the corners of the space resulting in directional changes in the distribution network 10, or may be positioned along a substantially linear section of the duct 20. In one embodiment, junction boxes 30 include mounting mechanisms for attaching to the wall of the conditioned space for supporting the distribution network 10. Holes 31, as illustrated in FIG. 3A, positioned along the mounting surfaces 37 are sized for fastening devices such as screws and the like for securing the junction boxes 30 to the walls. Ducts 20 are then inserted within the openings 32 and thereby supported by the junction boxes 30 without themselves being directly secured to the room walls. Openings (not illustrated) within the duct mounting surfaces 24 may be available for further mounting the ducts 20 to the wall of the conditioned space.

The distribution network 10 may be positioned at a variety of heights along the wall of the conditioned space. In one embodiment, the junction box top surface 38 and duct top surface 25 are positioned against the ceiling of the conditioned space. In another embodiment, the distribution network 10 is positioned downward from the ceiling such that a lighting system may be mounted between the duct top surface 25 and the room ceiling. A chamber assembly 35 may extend upward from the junction box top surface 38 to abut the ceiling for further securing the junction box 30 and also providing an aesthetically pleasing appearance.

One or more of the junction boxes 30 within the distribution network 10 includes an opening 40 through which air is supplied from an air handler, such as a heating or air conditioning system. Air opening 40 is positioned on one of the mounting surfaces 37 such that it is not visible to a viewer. An air control mechanism 29 may be positioned over the air opening 40 to control or modify the flow of incoming air.

FIG. 4 illustrates the air distribution network 10 positioned on the wall of a conditioned space. Conditioned air from the air handler enters the network through air opening 40 where it is directed through ducts 20 and junction boxes 30. Achieving good thermal comfort within the conditioned space may not require a duct 20 with diffusers on every wall of the conditioned space. However, the duct 20 serves an aesthetic function that may motivate including a duct 20 on every wall of the conditioned space. For reasons of economy, ducts may be fabricated without diffusers and may be installed in such a manner as not to conduct air. On the other hand, such ducts may be used to conduct air to another conditioned space. Therefore, junction boxes 31 and ducts 21 are not equipped for conducting air through the distribution network 10. These aesthetic pieces 21, 31 have the same exterior surface as the functional air distribution pieces 20, 30 such that a consistent aesthetic is maintained throughout the conditioned space.

Ducts 20 and junction boxes 30 may also be used for removing air from the conditioned space. The aesthetic appearance of these elements is the same as the air distribution elements. Air from the conditioned space enters through inlets and is directed along the ducts 20 and junction boxes 30 to an exit port 60. Air flow controllers may be positioned within the junction boxes 30 to further assist in the air movement.

Figure 5:
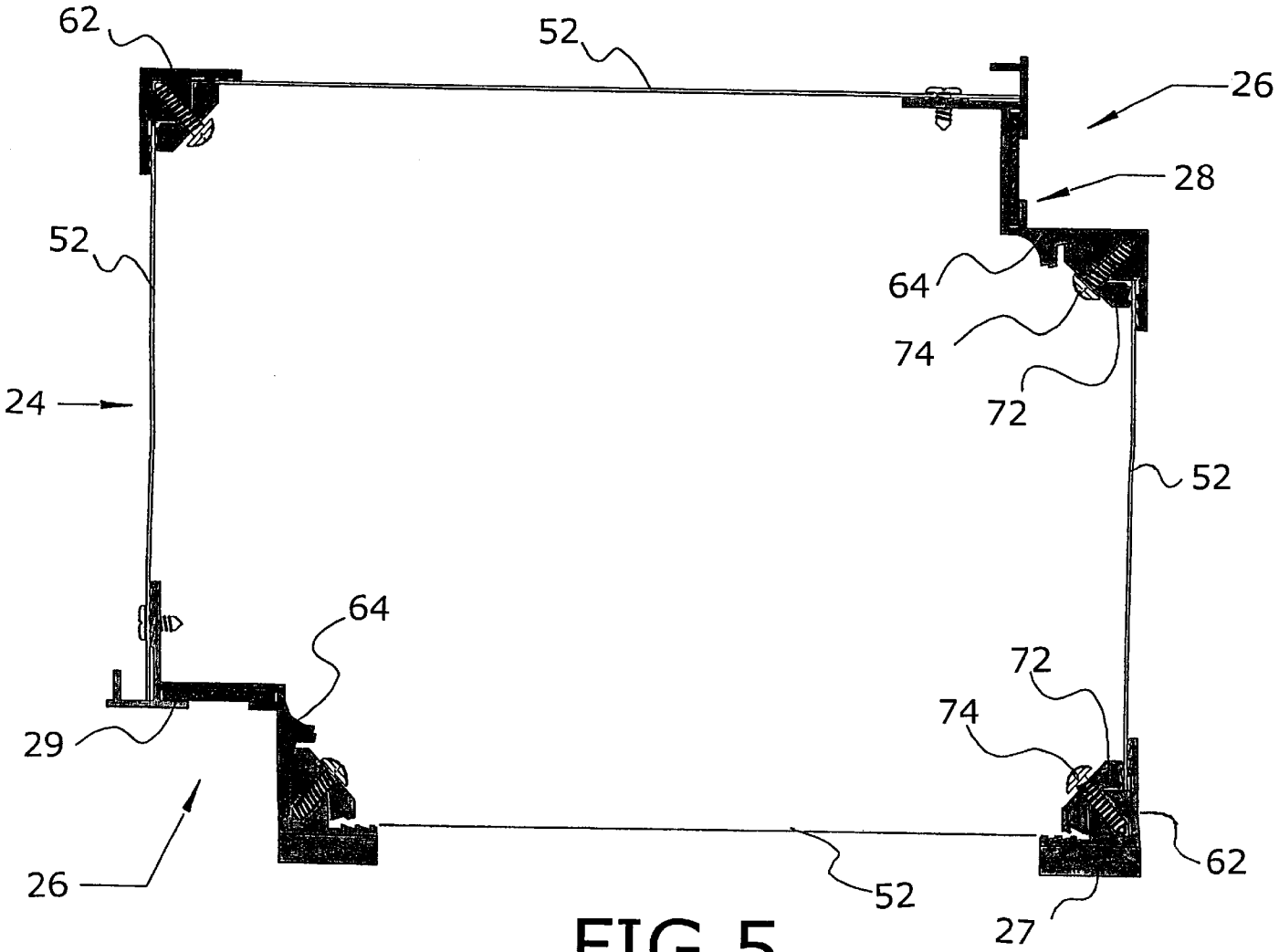
FIG. 5 is a cross-sectional view of the duct constructed in accordance with one embodiment of the present invention.

FIG. 5 illustrates a duct 20 constructed according to one embodiment of the present invention. The duct 20 is constructed of separate side sections 52 and joining edge elements 62, 64. Side sections 52 may have a variety of shapes and orientations depending upon the desired cross-sectional dimensions of the duct 20. As illustrated in FIG. 5, four separate side sections 52 are joined together to form the duct 20, although other numbers of different sections may be used to form the duct. Additionally, side sections 52 may have a substantially straight orientation, or may have a curved orientation (not illustrated).

Joining edge elements 62, 64 are positioned within the corners of the duct 20 to connect the side sections 52. Side sections 52 are positioned against an inner edge of joining edge elements 62, 64 and held in position by gripping bars 72 and fasteners 74. In the embodiment illustrated in FIG. 5, fasteners 74 attach from the interior of the duct such that they are not visible to a viewer within the conditioned space. Serrated grooves within the joining edge elements 62, 64 are sized to receive the fasteners 74. Joining edge elements 62, 64 may further form a section of the ornamental surface 22 and may include additional ornamentation to further improve the aesthetic appearance.

Elements 64 may additionally be shaped to form the recess 26 for hiding the outlet 28. Flow control mechanisms 29 may further be positioned within the outlets 28. Projections 27 may be mounted on the exterior surface of the mounts 62, 64 to further enhance the aesthetic appearance and to obscure the recess 26.

The present invention may be carried out in other specific ways than those herein set forth without departing from the scope and essential characteristics of the invention. The present embodiments are, therefore, to be considered in all respects has illustrative and not restrictive, and all changes coming within the meaning and equivalency range of the appended claims are intended to be embraced therein.

What is claimed is:

1. An air conducting and diffusing device to be used within a conditioned space comprising:

a) a duct for conducting conditioned air comprising at least one duct wall creating an interior volume in which the conditioned air flows;

b) at least one opening in said duct wall to diffuse the conditioned air from said interior volume through said duct wall into the conditioned space;

c) at least one recess in said duct wall to provide a location for said opening, said recess being positioned in a comer of said duct wall; and d) at least one ornamental surface on an exterior surface of said duct wall.

2. The device of claim 1 wherein said recess is adjacent to said ornamental surface.

3. The device of claim 1 wherein said opening comprises a control mechanism for adjusting a flow rate of the conditioned air.

4. The device of claim 1 wherein said ornamental surface comprises an outward projection further increasing a depth of said recess.

5. The device of claim 1 further comprising joining edge elements connecting at least two of said duct walls.

6. The device of claim 1 further comprising a light source positioned on said duct wall.

7. The device of claim 1 wherein said duct comprises an upper surface that is not visible to an occupant within the conditioned space, said upper surface being designed to support an item.

8. The device of claim 7 wherein said item is selected from a group consisting of luminaries, telephone lines, electric cables, data cables and fiber optic cables.

9. The device of claim 1, wherein said recess is formed by a first edge and a second edge joined together at approximately a right angle.

10. The device of claim 9, wherein the first edge is substantially parallel with said duct wall and said second edge is substantially perpendicular to said duct wall, said at least one opening being positioned in said first edge.

11. An air distribution system to conduct and diffuse conditioned air into a conditioned space, comprising:

a) a plurality of ducts, each having duct walls designed to be visible within the conditioned space;

b) at least one opening located in said duct walls to diffuse the conditioned air into the conditioned space;

c) at least one recess located in said duct walls to provide a location for said at least one opening, said at least one recess being positioned in a comer of said duct walls; and d) a plurality of junction boxes placed within the conditioned space to connect together said ducts and allow the conditioned air to flow into and out of said ducts, said plurality of junction boxes having an exterior surface that is visible within the conditioned space.

12. The system of claim 11 wherein at least one of said junction boxes connects said air distribution system to an air conditioning device.

13. The system of claim 11 wherein an air flow controller is positioned within at least one of said junction boxes to control the air flow into or from said ducts.

14. The system of claim 11 wherein said ducts have ornamental surfaces that are visible within the conditioned space.

15. The system of claim 11 wherein said air distribution system is adapted to be positioned along an edge formed by a wall and a ceiling of the conditioned space, and said openings being positioned to diffuse the conditioned air along the wall or the ceiling of the conditioned space.

16.The system of claim 15 wherein said ducts comprise a first opening to diffuse the conditioned air along the wall and a second opening to diffuse the conditioned air along the ceiling.

17. The system of claim 15 wherein said air distribution system is adapted to be positioned below an edge formed by the wall and the ceiling of the conditioned space, said ducts further comprising lights.

18. The system of claim 11, wherein said junction boxes are adapted to be positioned at corners of the conditioned space.

19. The system of claim 11, wherein said junction boxes are adapted to be positioned between corners of the conditioned space.

20. The system of claim 11, wherein said junction boxes comprise an opening to mount an end of said duct.

21. The system of claim 11, wherein said ducts further comprise a mounting surface adapted to attach said ducts to the walls of the conditioned space.

22. The system of claim 13, wherein said air flow controller is selected from the group consisting of a baffle, damper, heat exchanger, booster fan and filter.

23. The system of claim 11, further including openless ducts to conduct air through the system.

24. The system of claim 11, further comprising at least one non-functional duct.

25.The system of claim 11, further comprising at least one non-functional junction box having the same aesthetic appearance as said junction box.

26. An air distribution system to distribute air throughout a conditioned space, said system comprising:

a) a plurality of ornamental junction boxes placed within the conditioned space, at least one of said junction boxes comprising an air opening to supply air into the system and at least one of said junction boxes comprising an exit port to remove air from the system, said junction boxes comprising an ornamental exterior that is visible within the conditioned space; and b) a plurality of ducts extending between said junction boxes, each of said ducts having ornamental exterior walls that are visible within the conditioned space, at least one of said ducts having openings to supply air from said air opening into the conditioned space, at least one of said ducts comprising openings to direct air from the conditioned space to said exit port, and at least one of said ducts having continuous walls to conduct air.

* * * * *